US005725262A

United States Patent [19]

Kritzler

[11] Patent Number: 5,725,262

[45] Date of Patent: Mar. 10, 1998

[54] PULL-TYPE HANDLE FOR MOTOR-VEHICLE DOOR LATCH

[75] Inventor: Dietmar Kritzler, Lüdenscheid, Germany

[73] Assignee: Kiekert AG, Heiligenhaus, Germany

[21] Appl. No.: 653,763

[22] Filed: May 24, 1996

[30] Foreign Application Priority Data

Jun. 2, 1995 [DE] Germany ..... 195 19 738.0
Jul. 6, 1995 [DE] Germany ..... 195 24 568.7

[51] Int. Cl.[6] ..... E05B 3/00

[52] U.S. Cl. ..... 292/336.3; 292/DIG. 31

[58] Field of Search ..... 292/336.3, 337, 292/216, DIG. 23, DIG. 30, DIG. 31

[56] References Cited

U.S. PATENT DOCUMENTS

| | | | |
|---|---|---|---|
| 4,796,934 | 1/1989 | Kesel et al. | 292/216 X |
| 4,889,373 | 12/1989 | Ward et al. | 292/336.3 |
| 5,007,668 | 4/1991 | Di Giusto | 292/337 X |
| 5,056,838 | 10/1991 | Tiesler et al. | 292/336.3 |
| 5,123,687 | 6/1992 | Pfeiffer et al. | 292/336.3 |
| 5,263,750 | 11/1993 | Smith et al. | 292/336.3 |
| 5,282,657 | 2/1994 | Clinch et al. | 292/DIG. 31 X |
| 5,377,450 | 1/1995 | Varaqjon | 292/336.3 X |
| 5,497,640 | 3/1996 | Kokuryo | 292/336.3 X |

FOREIGN PATENT DOCUMENTS

| | | |
|---|---|---|
| 0 508 580 A1 | 2/1992 | European Pat. Off. . |
| 30 30 519 C2 | 2/1982 | Germany . |

*Primary Examiner*—Rodney M. Lindsey
*Attorney, Agent, or Firm*—Herbert Dubno; Andrew Wilford

[57] ABSTRACT

A motor-vehicle door latch mounted on a door has a vertically displaceable actuating element serving to open the latch. An actuating system for the latch has a handle, a mounting plate supporting the handle on the door above the latch, and a pivot on the mounting plate for horizontal movement of the handle on the plate between an unactuated position generally flush with the door and an actuated position spaced horizontally outward from the door. A coupling lever pivoted on the door about a horizontal axis has one arm connected to the handle and another arm. A link extends vertically between the other arm and the actuating element so that when the handle is displaced horizontally into the actuated position the lever is pivoted and the link is displaced vertically.

6 Claims, 7 Drawing Sheets

PULL-TYPE HANDLE FOR MOTOR-VEHICLE DOOR LATCH

FIELD OF THE INVENTION

The present invention relates to a motor-vehicle door latch. More particularly this invention concerns a pull-type handle for such a latch.

BACKGROUND OF THE INVENTION

A standard motor-vehicle door latch as described in European 0,508,580 of Isaacs et al has a latch and an actuator. The latch is mounted on the door edge and normally comprises a pivotal lock fork that can engage in a closed position around a doorpost-mounted bolt to retain the door shut, a retaining pawl engageable with the bolt and movable between a holding position with the bolt held in the closed position and a freeing position allowing the fork to pivot into an open position in which the bolt can move freely out of or into the latch, at least one actuating lever that is connected to the pawl to operate it, and normally at least one locking lever that can block or disconnect the actuating lever. The actuator is mounted normally somewhat above the latch on an outer surface or panel of the door and typically comprises a mounting plate itself fixed to the door and a handle that can be moved relative to the plate. A linkage is provided between the handle and the actuating lever so that movement of the handle is transmitted to the lever to operate the latch.

It is also standard to have an inside actuator provided with an inside door handle. Furthermore the outside actuator can incorporate a lock cylinder or the like that is connected via a linkage to the lock lever in the latch to decouple the outside handle at least from the latch in a locked position or to block movement of the outside handle.

In above-cited European 0,508,580 the handle is of the lift type pivotal about a horizontal axis between an unactuated position generally flush with the door and an actuated position projecting horizontally out of the door. Such a handle has an inwardly projecting arm that, in the normal situation where the latch is spaced somewhat below the actuator, is connected via a vertical link rod to a vertically displaceable part of an actuator lever of the latch.

Such a handle pivotal about a horizontal axis has several disadvantages. First of all, violent actuation of the handle can actually deform or tear the outer panel or skin of the door. It is also possible to pinch ones fingers under the handle when it is pulled out, or when it is released to snap back under spring force.

In an alternative system described in German patent 3,030,519 of Keller et al the outside handle is of the swing type pivotal about a vertical axis at one end. A hook mounted at the opposite end of the handle moves horizontally when the handle is actuated and is normally connected directly to the latch. Thus such a system is only suitable when the actuator and latch are mounted at the same level on the door. The horizontally moving handle end cannot operate a latch offset from it that has a vertically displaceable actuating lever.

OBJECTS OF THE INVENTION

It is therefore an object of the present invention to provide an improved motor-vehicle door latch.

Another object is the provision of such an improved motor-vehicle door latch which overcomes the above-given disadvantages, that is which has a handle of the swing type pivotal about a vertical axis but that can be used with a standard latch that may be offset vertically from the outside actuator.

SUMMARY OF THE INVENTION

A motor-vehicle door latch mounted on a door has a vertically displaceable actuating element serving to open the latch. An actuating system for the latch has according to the invention a handle, a mounting plate supporting the handle on the door above the latch, and a pivot on the mounting plate for horizontal movement of the handle on the plate between an unactuated position generally flush with the door and an actuated position spaced horizontally outward from the door. A coupling lever pivoted on the door about a horizontal axis has one arm connected to the handle and another arm. A link extends vertically between the other arm and the actuating element so that when the handle is displaced horizontally into the actuated position the lever is pivoted and the link is displaced vertically.

According to the invention a rigid connecting element has one end fixed to the latch and an opposite end fixed to the plate. The actuator further includes a key cylinder accessible from outside the door and another link rod connected between the key cylinder and the latch. The connecting element is L-shaped and partially surrounds the other link rod. Thus this connecting element serves two purposes: joining the two subassemblies together into an assembly that can be mounted as one piece in the vehicle door, and shielding the lock link rod to make actuation of the latch, for instance by a bar slipped down in the window slot, impossible.

A spring is provided braced between the plate and the lever for urging the handle into the unactuated position. This spring therefore also urges the latch into the latched position.

The coupling lever in accordance with this invention has a first normally vertical arm connected to the handle and a second normally horizontal arm connected to the link rod. When the handle is actuated the vertical arm is tipped as is the horizontal arm. Both arms have inner ends at the horizontal axis and outer ends. The coupling lever further has a third normally vertical arm extending from the horizontal axis opposite to the first arm so that in a side collision a force of 30 gravities can be effective horizontally on the lever without actuating the latch.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
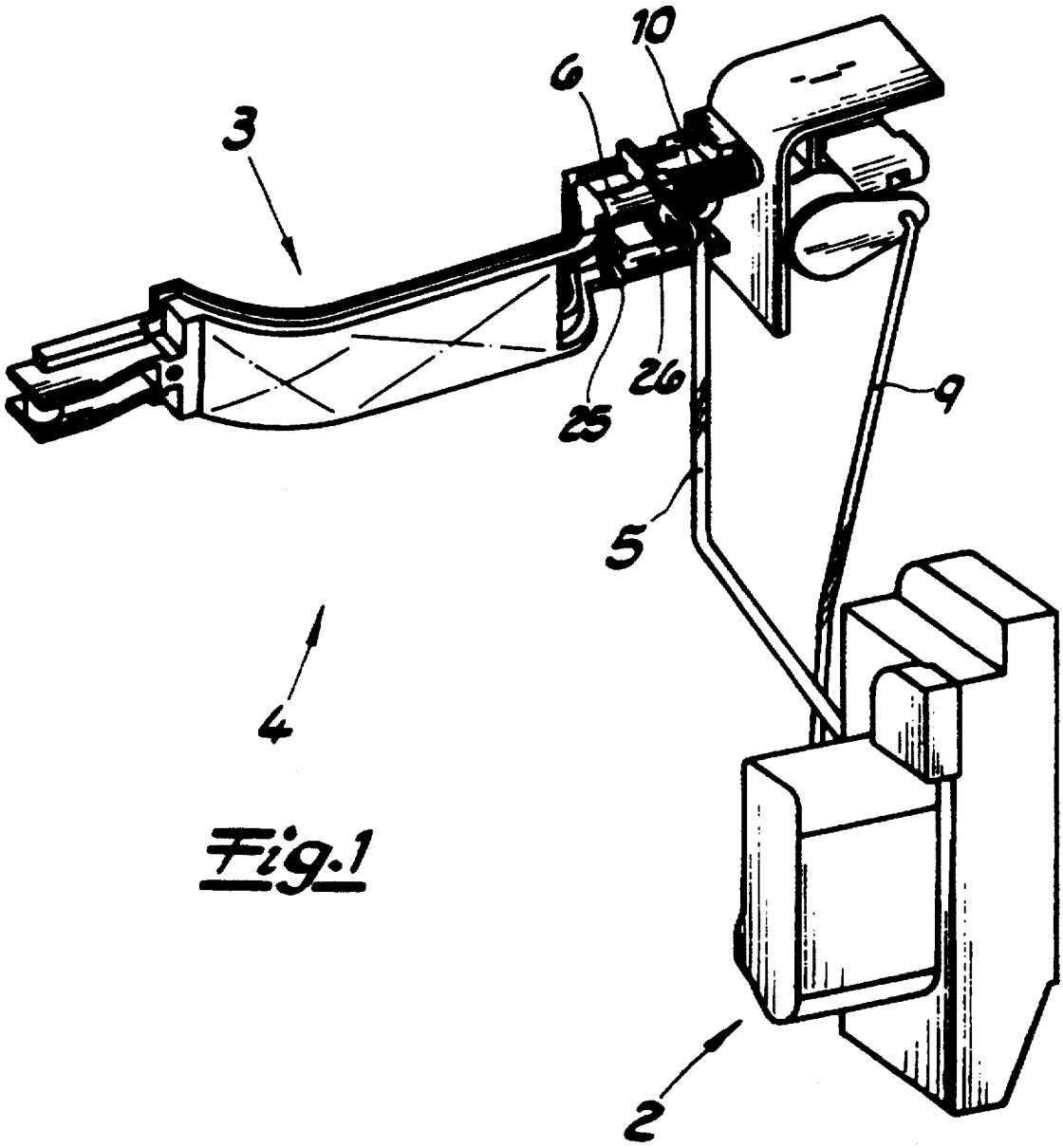
FIG. 1 is a perspective view from inside of a latch assembly according to the invention with some parts removed for clarity of view.
Figure 2:
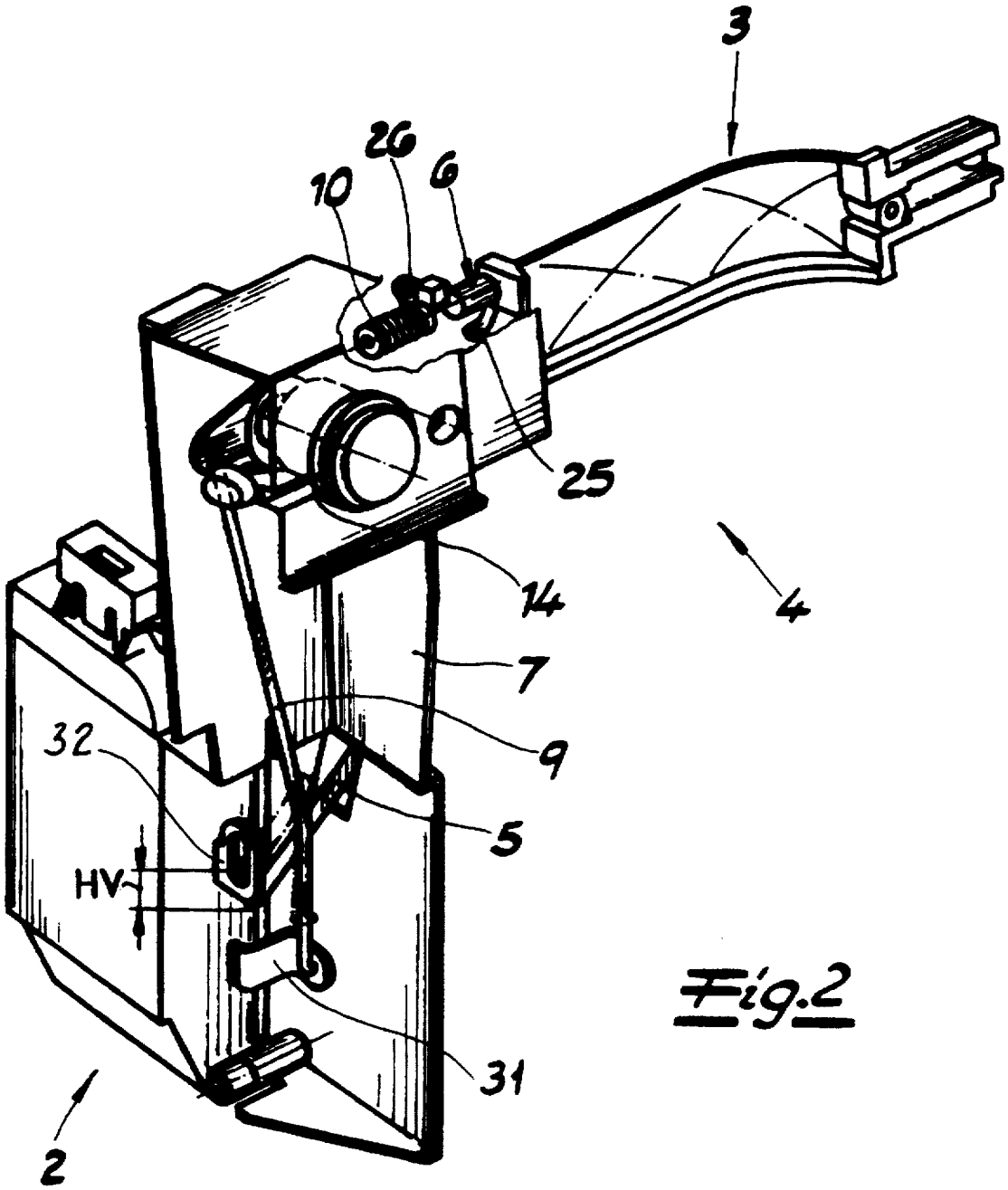
FIG. 2 is a view like FIG. 1 but from outside the door.
Figure 3:
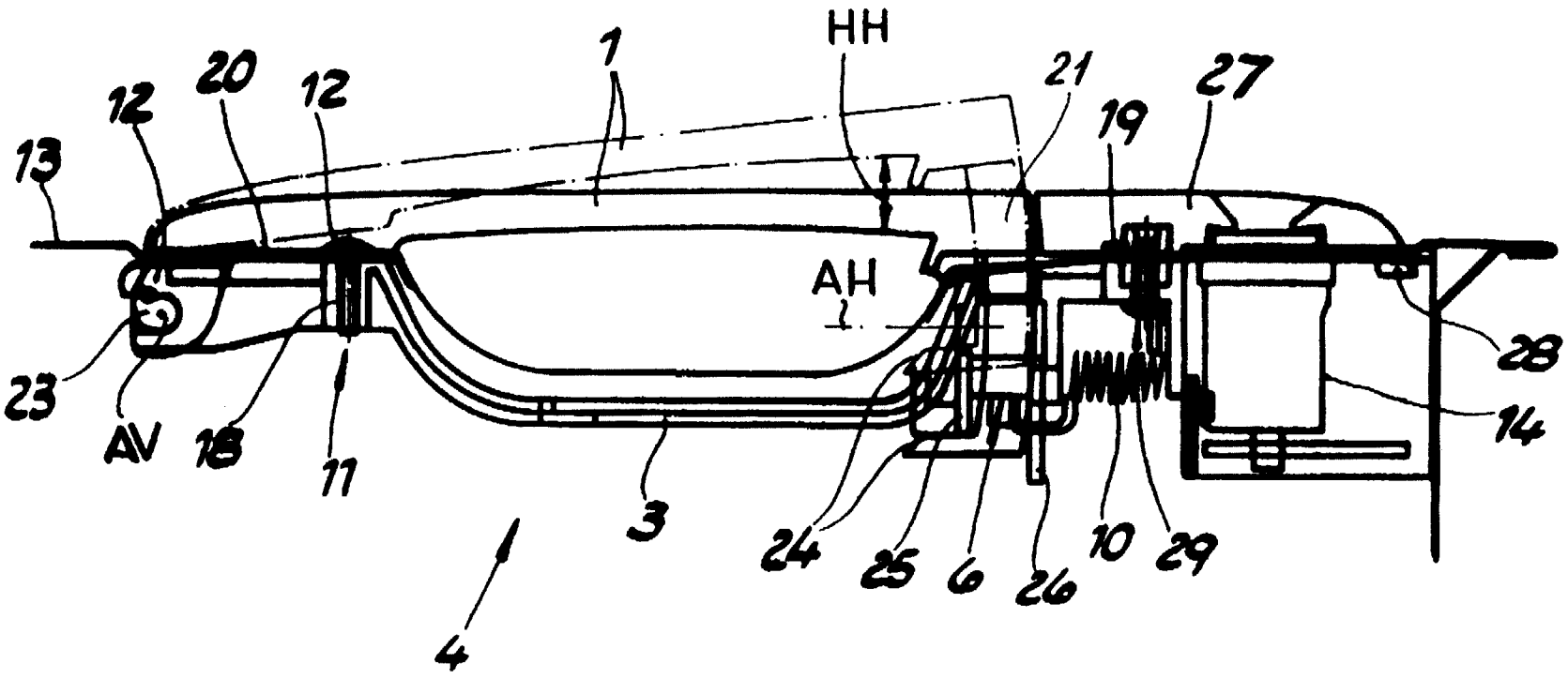
FIG. 3 is a top view of the installed outside actuator.

As seen in FIGS. 1 and 2 the latch assembly according to the invention has a latch 2 normally mounted on an edge of a motor-vehicle door 8 and an outside actuator 4 normally mounted on an outside door panel 13 somewhat above the latch 2. The actuator 4 and latch 2 are bolted to an L-section connecting element or plate 7 of sheet metal to form as shown in FIG. 2 a rigid preassembled unit that can be mounted in the door 8 from inside as a single part. The latch 2 comprises the standard fork, retaining pawl, and actuating levers well known in the art, with only a vertically displaceable end of a locking lever 31 and another vertically displaceable end of an actuating lever 32 shown in the drawing. The plate 3 also carries a lock cylinder 14 connected via a link rod 9 to the locking lever 31. The L-shaped element 7 wraps around two sides of the rod 9 to shield it against someone trying to manipulate it via the door's window slot.

The actuator 4 comprises a mounting plate 3 fitted to a pocket or hole in the outer door panel 13 and a handle 1 pivoted on the plate 3 about a vertical axis AV and a two-arm lever 6 pivoted on the plate 3 about a horizontal axis AH. The lever 6 has a normally vertical and downwardly extending leg 25 pivoted at its lower free end on the handle 1 and a normally horizontal and inwardly extending arm 26 on whose free inner end is pivoted the upper end of another link rod 5 whose lower end is connected to the actuator lever 32. A torque spring 10 engaged between the lever 6 and the plate 3 urges the lever 6 into a rest position with the arm 25 vertical and extending downward from the axis AH, the arm 26 horizontal and extending inward from the axis AH, and the handle 1 in the unactuated position generally flush with the door 8, in the pocket created by the plate 3. Thus this lever 6 converts a horizontal displacement HH of the free end of the handle 1 into a vertical displacement HV of the rod 5 and lever 32.

Figure 4A:
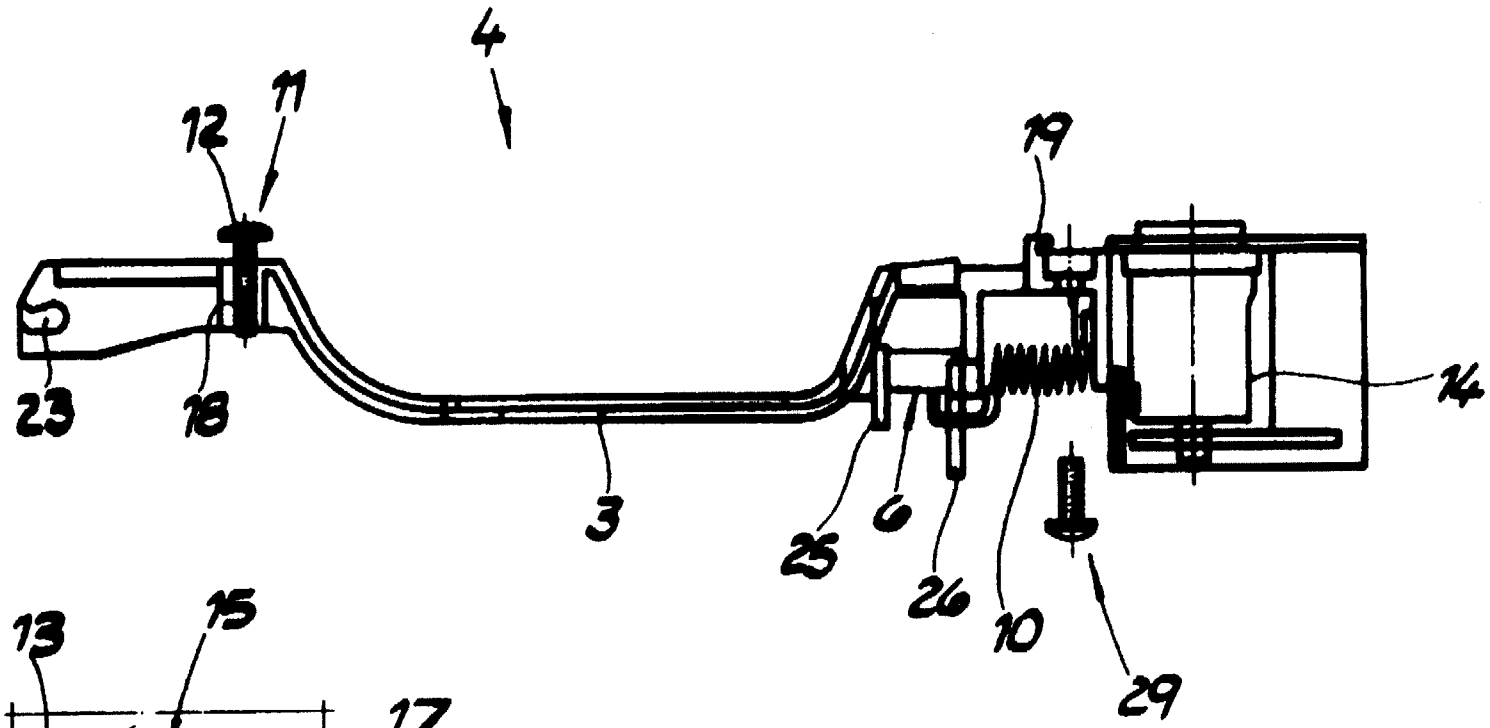
FIG. 4*a* is a top view of the outside actuator prior to installation.
Figure 4B:
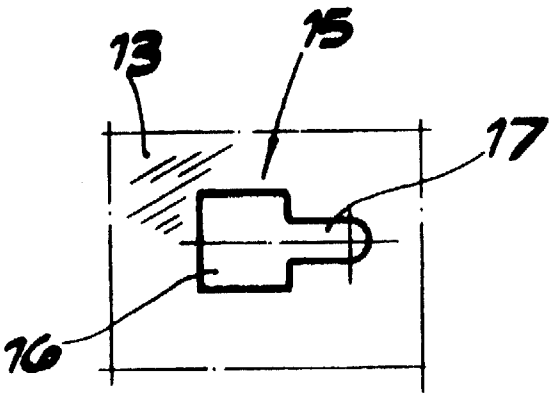
FIG. 4*b* is a view of a detail of the door in which the assembly is mounted.
Figure 5:
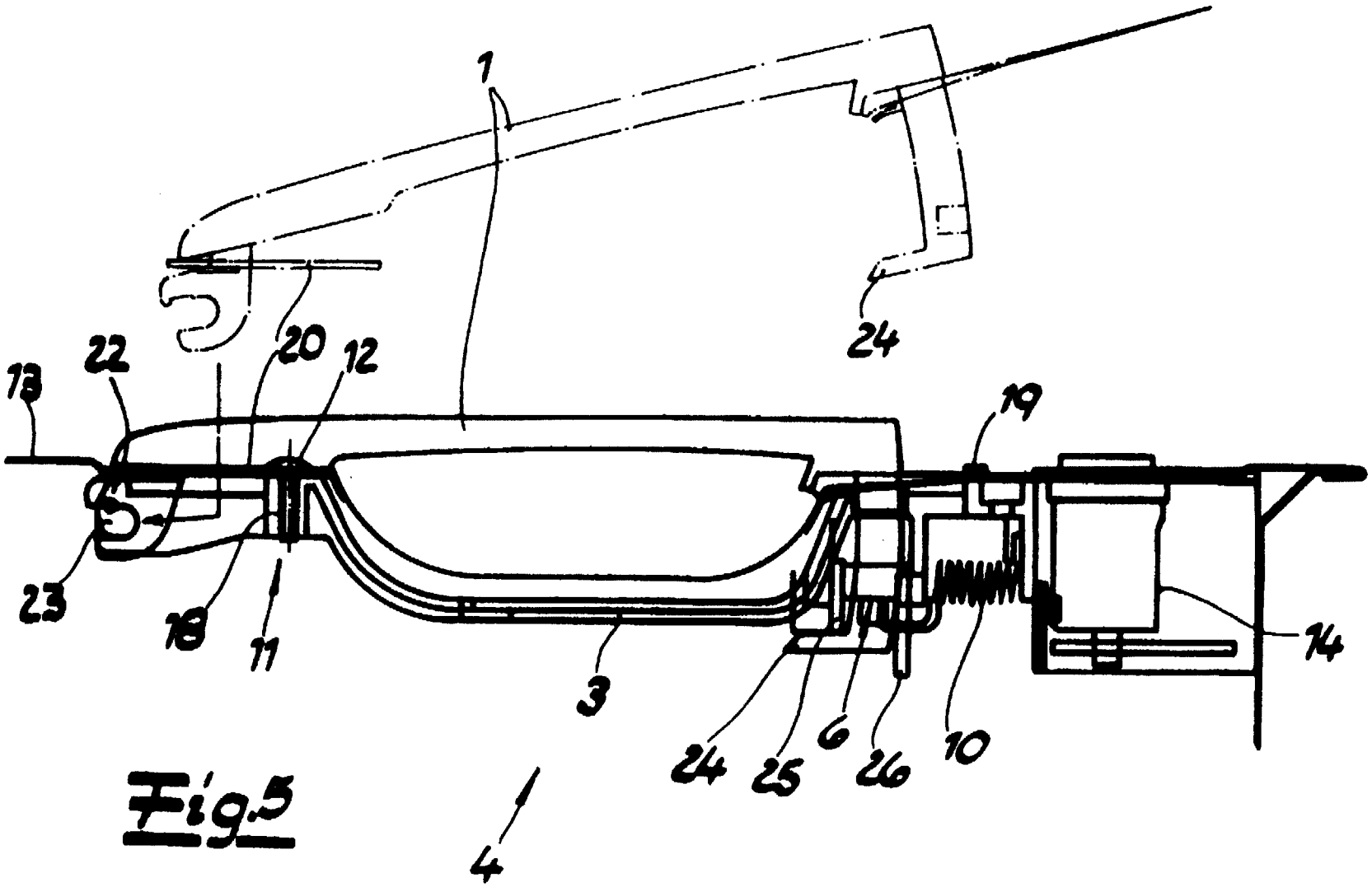
FIG. 5 is a view like FIG. 3 illustrating installation of the outside actuator.
Figure 6:
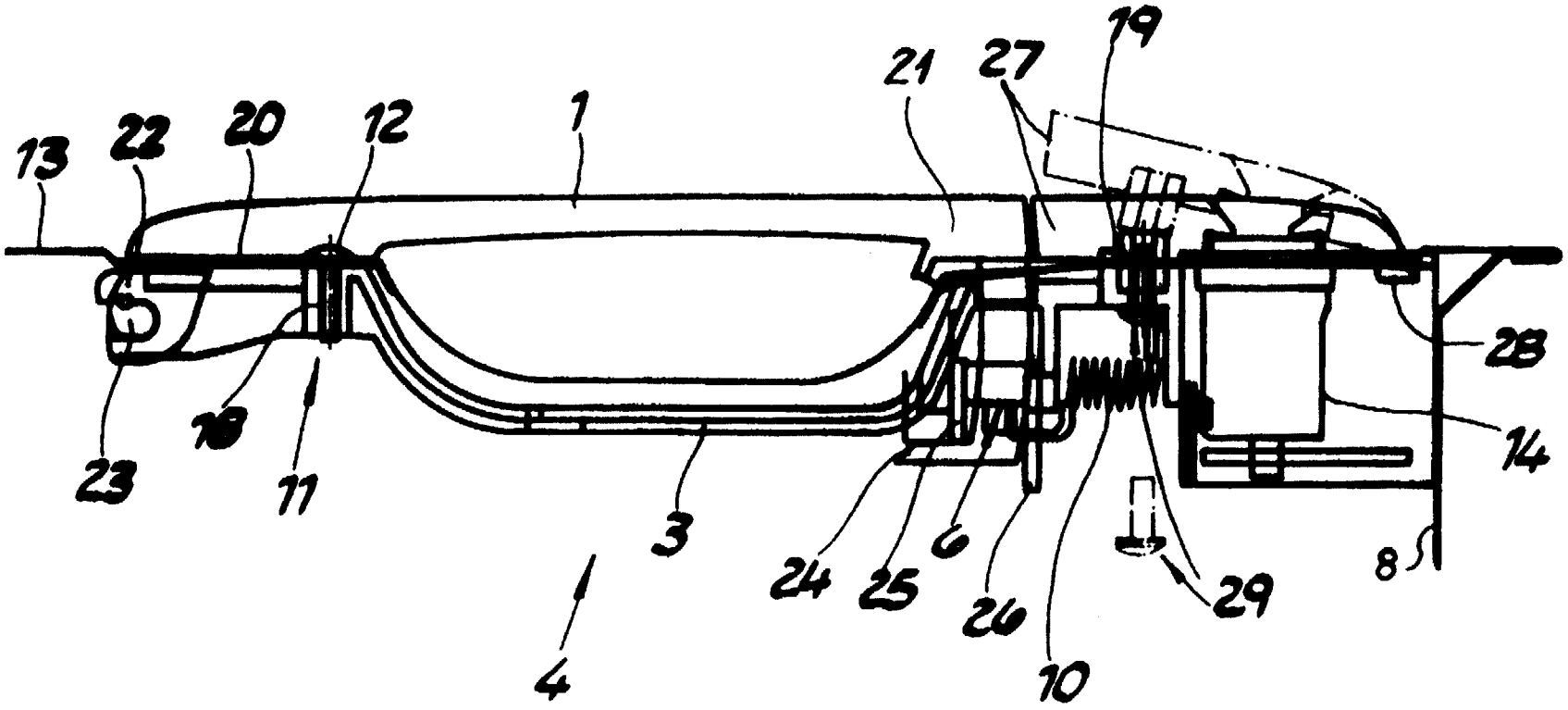
FIG. 6 is a view like FIG. 5 of the last stages of the installation of the outside actuator.

The door panel 13 is formed at a pivoted rear end 20 of the handle 1 with a hole 15 (FIG. 4*b*) having a modified keyhole shape, with a rear wide portion 16 and a front narrow portion 17. The plate 3 (FIG. 4*a*) is fitted prior to installation with a screw 11 having a threaded shank of a diameter equal to slightly less than the width of the portion 17 and a head 12 wider than the portion 17 but narrower than the portion 16. Thus the actuator 4 is mounted in the door panel 13 by first fitting to it the screw 11, with its head 12 spaced outward by more than the thickness of the panel 13, and then fitting the plate 3 to the inside face of the panel 13 with the head 12 passing through the wide portion 16. The entire plate 3 is then slid forward so the screw shank 18 engages in the narrow hole portion 17, and the screw 11 is tightened. The end of the plate 3 opposite the screw 11 has a pair of hooks 19 that fit over the edge of the panel 13 when it is slid forward to lock it solidly in place.

Then arms 22 of the rear end 20 of the handle 1 are fitted over a pivot 23 of the plate 3 while a hook 24 at a front end 21 of the handle 1 engages the arm 25 of the lever 6. A cap 11 is fitted over the front end of the cover plate 3 and secured in place from inside by a screw 29 with an undercut hook tab 28 of this cover 27 engaged through the door panel 13 to stabilize it.

Figure 7:
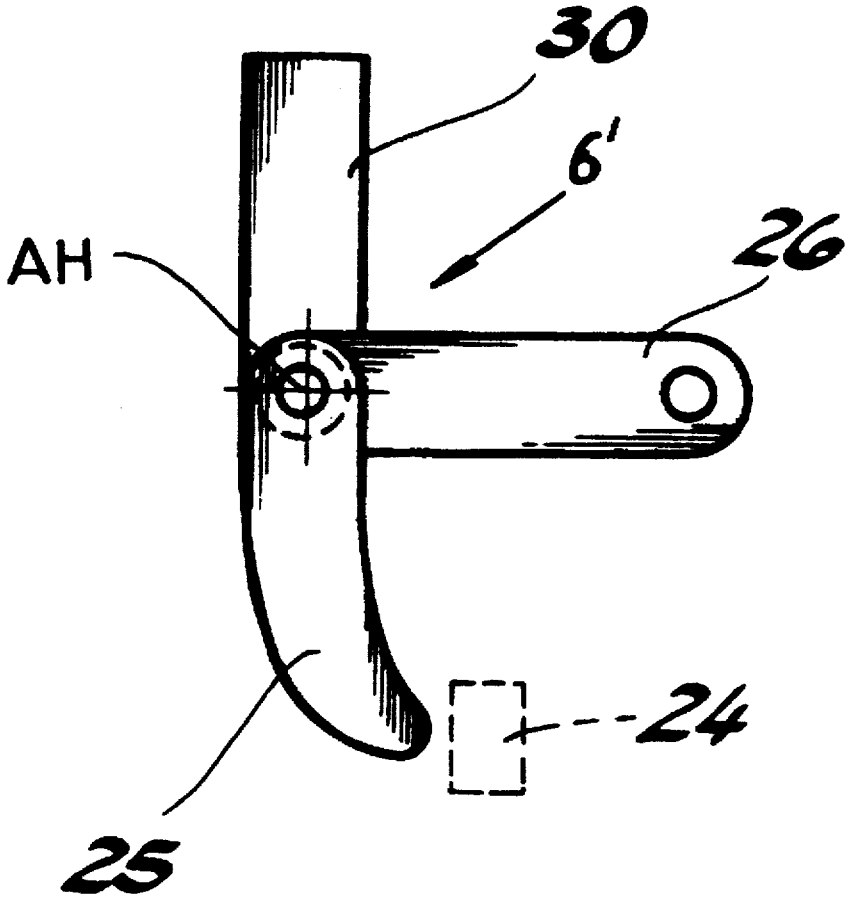
FIG. 7 is a detail of a variant of the instant invention.

FIG. 7 shows how the lever 6' can be T-shaped and provided with another arm 30 extending vertically opposite to the arm 25 and serving as a counterweight. This arm 30 functions to prevent opening of the door 8 in a side collision. Without it the inertia of the arm 25 could swing the lever 6' so as to actuate the lock, but with the arm 30 both arms 25 and 30 will be subjected to the same force, canceling each other out and preventing the door 8 from opening even at a force of 30 g(ravity) which is possible in a collision.

I claim:

1. In combination with a motor-vehicle door latch mounted on a door and having a vertically displaceable actuating element serving to open the latch, an actuating system comprising:

an outside door handle;

a mounting plate supporting the handle on the door above the latch and forming with the handle an actuator;

means including a vertical pivot on the mounting plate for horizontal movement of the handle by pivoting about a vertical axis on the plate between an unactuated position generally flush with the door and an actuated position spaced horizontally outward from the door;

a coupling lever pivoted on the door about a horizontal axis and having one arm connected to the handle and another arm;

a link extending vertically between the other arm and the actuating element, whereby when the handle is displaced horizontally into the actuated position the lever is pivoted and the link is displaced vertically.

2. The motor-vehicle door latch defined in claim 1, further comprising a rigid connecting element having one end fixed to the latch and an opposite end fixed to the plate.

3. The motor-vehicle door latch defined in claim 2 wherein the actuator further includes a key cylinder accessible from outside the door, and another link rod connected between the key cylinder and the latch, the connecting element being L-shaped and partially surrounding the other link rod.

4. The motor-vehicle door latch defined in claim 1, further comprising biasing means including a spring braced between the plate and the lever for urging the handle into the unactuated position.

5. The motor-vehicle door latch defined in claim 1 wherein the coupling lever has a first normally vertical arm connected to the handle and a second normally horizontal arm connected to the link rod.

6. The motor-vehicle door latch defined in claim 5 wherein the arms both have inner ends at the horizontal axis and outer ends, the coupling lever further having a third normally vertical arm extending from the horizontal axis opposite to the first arm.

* * * * *